US006675814B2

(12) United States Patent
Gueret

(10) Patent No.: US 6,675,814 B2
(45) Date of Patent: Jan. 13, 2004

(54) DEVICES AND METHOD FOR APPLYING A PRODUCT TO HAIR

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 80 days.

(21) Appl. No.: 09/865,703

(22) Filed: May 29, 2001

(65) Prior Publication Data

US 2002/0174877 A1 Nov. 28, 2002

(30) Foreign Application Priority Data

May 26, 2001 (FR) ..... 00 06769

(51) Int. Cl.[7] ..... A45D 40/26

(52) U.S. Cl. ..... 132/218; 132/317; 132/320; 132/200; 401/126; 15/160; 15/207.2

(58) Field of Search ..... 132/218, 216, 132/317, 320, 217, 124, 125, 126, 142; 401/127, 128, 129, 126, 122; 15/207.2, DIG. 5, 160

(56) References Cited

U.S. PATENT DOCUMENTS

| | | | | | |
|---|---|---|---|---|---|
| 1,653,176 | A | * | 7/1927 | Dorment | 132/111 |
| 1,963,389 | A | * | 6/1934 | Vardeman | 15/188 |
| 2,007,245 | A | * | 7/1935 | Gimonet | 132/218 |
| 2,476,201 | A | * | 7/1949 | Ligoure | 15/188 |
| 3,073,320 | A | * | 1/1963 | Seaver | 401/121 |
| 3,384,083 | A | | 5/1968 | Cozza et al. | |
| 3,763,870 | A | | 10/1973 | Montgomery et al. | |
| 3,896,823 | A | * | 7/1975 | Spatz | 132/218 |
| 3,921,650 | A | | 11/1975 | Montgomery | |
| 3,930,280 | A | * | 1/1976 | Vasas | 15/257.05 |
| 3,998,235 | A | * | 12/1976 | Kingsford | 132/218 |
| 4,122,554 | A | | 10/1978 | Stager | |
| 4,635,659 | A | * | 1/1987 | Spatz | 132/218 |
| 4,660,582 | A | * | 4/1987 | Taylor | 132/218 |
| 5,086,793 | A | | 2/1992 | Kingsford | |
| 5,094,254 | A | * | 3/1992 | Krueckel et al. | 132/218 |
| 5,224,787 | A | * | 7/1993 | Vasas | 401/119 |
| 5,339,480 | A | * | 8/1994 | Murg et al. | 15/106 |
| 5,655,551 | A | * | 8/1997 | Knight | 132/200 |
| 5,679,399 | A | | 10/1997 | Shlenker et al. | |
| 5,853,010 | A | * | 12/1998 | Suh | 132/217 |
| 5,947,130 | A | * | 9/1999 | Musum | 132/125 |
| 5,964,226 | A | * | 10/1999 | Sobel | 132/108 |
| 6,026,824 | A | | 2/2000 | Gueret | |
| 6,026,825 | A | | 2/2000 | De Laforcade | |
| 6,117,119 | A | | 9/2000 | Gould | |

FOREIGN PATENT DOCUMENTS

| | | | | |
|---|---|---|---|---|
| DE | 25 59 273 | | 7/1977 | |
| EP | 0 392 987 | A1 * | 3/1990 | A46B/15/00 |
| WO | WO 01/10567 | | 2/2001 | |

OTHER PUBLICATIONS

Co–pending Application—Attorney Docket No. 08048.0009–00000 Title: Application Member, Applicator, System, and Method Inventor(s): Jean–Louis H. Gueret U.S. Filing Date: May 29, 2001.

English language Derwent Abstract of DE 25 59 273, Jul. 7, 1977.

* cited by examiner

*Primary Examiner*—Eduardo C. Robert
*Assistant Examiner*—David Comstock
(74) *Attorney, Agent, or Firm*—Finnegan, Henderson, Farabow, Garrett & Dunner, LLP

(57) ABSTRACT

A device for applying a substance to hair comprises a wand provided on an end with an application element having a base portion and at least one wall connected over at least a portion of its length to the base portion and having at least one free edge defining notches having bottoms at a distance from the base portion. The sides of the wall may be substantially smooth. The length of the at least one free edge of the wall may be non-perpendicular to the longitudinal axis of the wand.

260 Claims, 5 Drawing Sheets

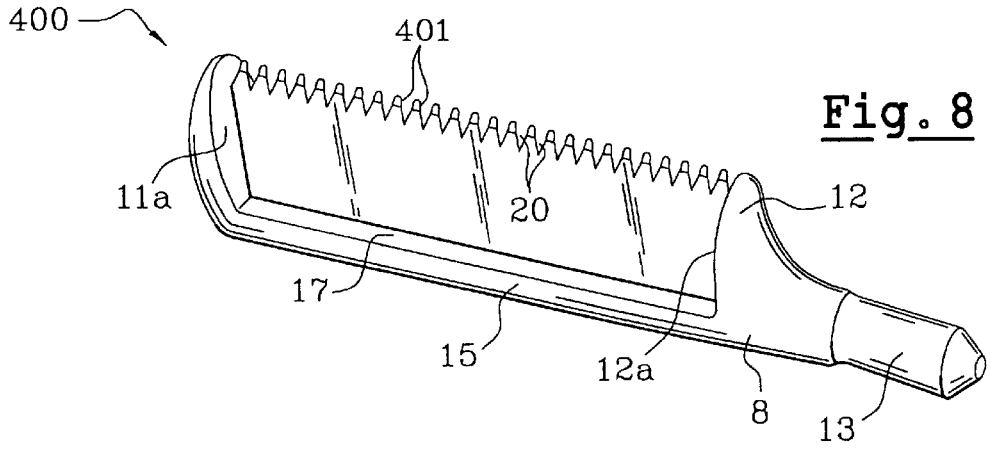
Fig. 8
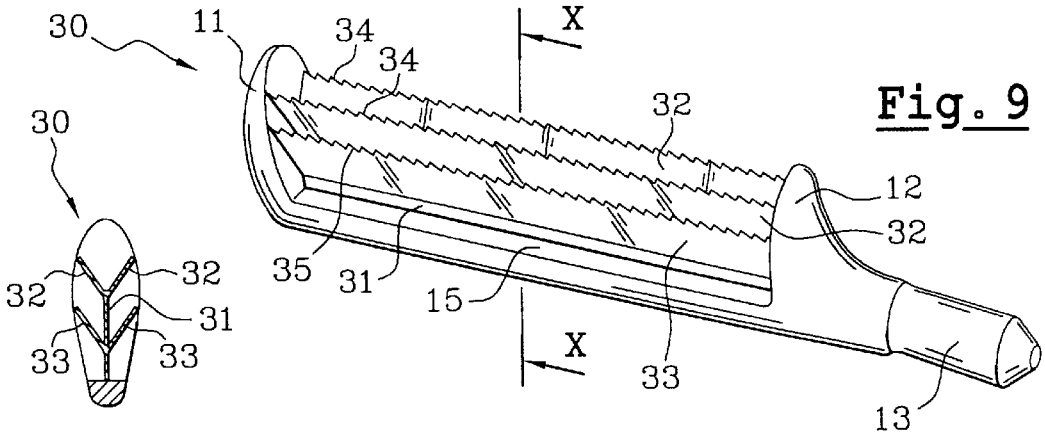
Fig. 9
Fig. 10
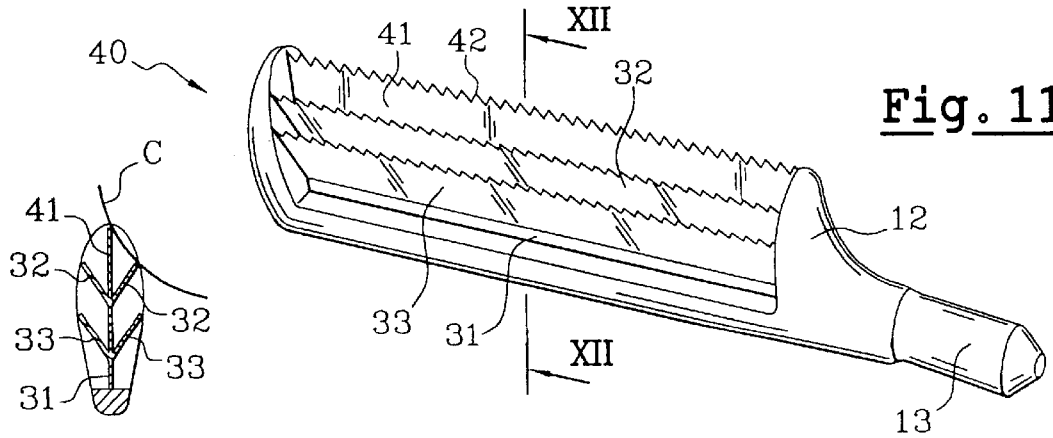
Fig. 11
Fig. 12

DEVICES AND METHOD FOR APPLYING A PRODUCT TO HAIR

The present invention relates to a device for applying a product, in particular a cosmetic or a care product, to hair, such as eyelashes, eyebrows, or any other type of keratinous fibers, for example. The device may include a wand, (e.g., stem) provided with an application member comprising a base portion carrying one or more elements for applying the product.

Conventional devices of this general type exist. However, there is a desire to have an application member that is capable of holding a relatively large quantity of the product so as to substantially limit the need to refill the application member with product too frequently during application of the product.

In conventional application members that may include a row of teeth, the amount of product retained between the teeth may depend on their spacing. The amount of product that may be taken up by the application member may then be limited by the fact that the teeth desirably remain relatively close together in order to allow the teeth to grip and take hold of the eyelashes during application of the product thereto. Such gripping may improve the combing function of the applicator.

One optional aspect of the present invention includes an applicator which may be capable of combing the eyelashes, or other hair, and of smoothing the product on the surface thereof in a satisfactory manner, while also optionally being comfortable to use and substantially limiting the need for refilling the application member with product too often.

Certain optional embodiments of the invention may achieve this by providing a device for applying a product to hair comprising a wand and an application member disposed on an end of the wand. The application member may have a base portion and at least one wall connected over at least a portion of its length to the base portion. The wall may have at least one free edge defining a plurality of notches having bottoms disposed at a distance, such as a non-zero distance, from the base portion.

In an optional aspect, the sides of the wall extending between the base portion and the at least one free edge are substantially smooth.

In another optional aspect, the length of the at least one free edge of the wall extends in a direction non-perpendicular to a longitudinal axis of the wand.

In yet another optional aspect, a longitudinal axis of the application member and a longitudinal axis of the wand are substantially parallel to each other.

In yet another optional aspect, a dimension of at least a portion of the wand in a direction perpendicular to a longitudinal axis of the wand is less than a length of the at least one free edge.

According to another optional aspect, a device for applying a product to hair includes a wand, a handling member disposed on a first end of the wand, and an application member disposed on a second end of the wand opposite to the handling member, the application member having a base portion and at least one wall connected over at least a portion of its length to the base portion. The wall may have at least one free edge defining a plurality of notches having bottoms disposed at a distance from the base portion.

In an optional aspect of the invention, the product may become deposited on the portion of the wall which extends between the base portion and the bottoms of the notches, thereby essentially forming supplies of product. This may make it possible to increase the time during which the application member can be used without the need for refilling it, while still allowing the application member to grip the eyelashes or other hair, to spread the product on the surface thereof, and to curve the hair, if desired.

In an optional embodiment, the device has a reservoir (e.g., receptacle) for containing the product to be applied. A wiper member for wiping product from the application member may be associated with the reservoir. The application member may be configured to be removably positioned within the reservoir. Optionally, the application member may be configured to be removed through an opening defined by the reservoir. Optionally, the wiper may wipe the application member as it is removed from the reservoir. In an optional embodiment, the reservoir may contain a mascara product. The application member may optionally be configured to apply a product to eyelashes. The wand optionally may be configured to be disposed in a reservoir without engaging with the reservoir to close the reservoir.

When a handling member is provided on an end of the wand opposite the application member, the handling member may form a closure cap for the reservoir. The handling member may be removably engagable with the reservoir so as to allow the reservoir to be opened and closed. The handling member optionally may include screw threading configured to cooperate with screw threading on the reservoir. In an optional aspect, the length of the wand may be at least approximately 3 centimeters and the length of the handling member may be at least approximately 3 centimeters. Also optionally, the handling member may include a skirt portion into which the wand extends. Screw threading optionally may be provided on an internal portion of the skirt portion.

The application member optionally may be formed integrally with the wand by molding, for example, an elastomer material. Alternatively, the application member may optionally be formed separate from the wand and may be attached to the wand.

By way of optional example, the application member may be made out of a plastic material that is more flexible than the plastic material used for making the applicator wand. This may provide an applicator that is comfortable to use.

In another optional embodiment, the application member may be integrally formed by molding as a single piece. The application member may be formed of an elastomeric material.

The wall of the application member optionally may be substantially planar. Also optionally, the wall may have folds. For example, the sides of the wall extending between the base portion and free edge may include folds. These folds optionally may extend substantially perpendicular to the free edge. The presence of folds may enhance a combing action on the eyelashes or other hairs. Such folds also may increase the surface area of the wall suitable for receiving the product, and also may increase the time during which the applicator may be used between refills. The folds optionally may be substantially perpendicular to a longitudinal axis of the base portion.

In an optional embodiment, the application member includes end portions, for example a front and rear end portion or lateral end portions, which may extend substantially perpendicular to the base portion at substantially opposite ends of the base portion. The base portion may interconnect the end portions. Optionally, the wall for applying the product may be connected, over all or part of its height to the end portions. Also optionally, the wall may have axial free ends. The base portion may optionally be disposed either centrally relative to the end portions or off-center relative to the end portions.

The thickness of the wall optionally may be less than a width of the base portion as measured in a direction perpendicular to a longitudinal axis of the base portion. A cavity may be defined by a surface of the base portion on which the wall is disposed and a side of the wall, the cavity being configured to hold a product to be applied.

The wall for applying the product may optionally be made of an elastomeric material, which may provide the application member with relatively more flexibility.

In an optional embodiment, the wall may have branch portions (e.g., ramifications) which may extend outwardly from another portion of the wall. Such a branch portion may optionally include a free edge defining notches. Each of these branches may have an edge provided with notches for applying the product to hairs.

The application member also optionally may have a plurality of edges defining notches for applying the product, which edges may optionally be arranged so that hair (e.g., an eyelash) can come into contact with at least two of them during application. The free edges optionally may substantially define an envelope surface interconnecting the end portions of the application member.

The base portion optionally may include a plurality of walls interconnecting the end portions of the application member. Each of these walls may have an edge having notches (e.g., serrations), spikes or teeth.

In yet another optional embodiment, the application member may have teeth, or spikes, on the free edge, with adjacent teeth forming the notches. Optionally, two rows of teeth or spikes may be disposed on a free edge of a wall. These teeth may optionally be axially offset along a longitudinal axis of the base portion, essentially forming a staggered configuration. Adjacent teeth optionally may be curved alternately outward to opposed sides with respect to the longitudinal axis of the application member.

The application member optionally has a plurality of walls disposed in a flared configuration when the application member is observed in cross-section along a longitudinal axis of the application member. Each wall may have at least one edge capable of combing hair. The walls disposed in a flared configuration optionally may be arranged so as to enable a hair to come into contact with two adjacent edges simultaneously during application.

According to certain optional embodiments, the free edge of the at least one wall may have a length that extends in a direction non-perpendicular to a longitudinal axis of the wand. Optionally, a longitudinal axis of the application member may be substantially parallel to the longitudinal axis of the wand on which the application member is provided, or, alternatively may be oriented at an angle, or substantially perpendicular, to the wand's longitudinal axis.

At least one wall for applying the product also may include spikes lying in or projecting from a respective plane thereof.

The application member optionally also may have a wall connected to the base portion via bridges of material that may leave gaps between one another in which the product can be held.

According to another optional aspect, the application member may include projecting elements, which may optionally be in the form of teeth or spikes, for example, disposed on the base portion adjacent the wall. Two rows of projecting elements may optionally be provided, with the rows optionally being disposed on opposite sides of the wall to one another.

The notches optionally may be V-shaped.

In another optional aspect, the wand has a substantially circular cross-section.

According to yet another optional aspect, at least a portion of the wand has a cross-sectional area that is smaller than a cross-sectional area of the application member. Also optionally, the base portion has a cross-sectional shape that differs from a cross-sectional shape of the wall. The base portion optionally may be elongated substantially in a direction of a longitudinal axis of the wand.

According to yet another optional aspect of the invention, a method of applying a product to hair comprises providing a device of any of the optional types discussed above, loading at least a portion of the application member with a product to be applied to hair, and placing the application member in contact with the hair such that the product is applied to the hair.

According to an optional aspect, the loading may include loading at least some of the notches with the product. According to yet another optional aspect, the loading includes inserting the application member into a reservoir containing the product. Also optionally, the placing the application member in contact may include contacting the hair with the bottoms of at least some of the notches.

Yet another optional aspect of a method according to certain optional embodiments of the invention, includes gripping the hair with the bottoms of at least some of the notches.

The product to be applied according to certain optional embodiments of the invention is mascara and the hair includes eyelashes. Optionally, the product is chosen from a solid, a semi-solid, a liquid, and a liquid-to-pasty product.

Yet other optional objects will become apparent from the detailed description which follows. The devices and methods of applying described herein may optionally solve some or all of the problems discussed above with reference to conventional applicator devices and methods. It should be understood that the invention could be practiced without performing one or more of the optional objects and/or advantages described above. Certain other optional aspects of the invention will become apparent from the detailed description which follows.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of this specification. The drawings illustrate optional embodiments of the invention and, together with the description, serve to explain some principles of the invention. In the drawings, FIG. 1 is a perspective view of an optional embodiment of a device according to an optional aspect of the present invention shown in an open position;

FIG. 8 is a perspective view of an application member according to yet another optional embodiment of the invention;

FIG. 9 is a perspective view of an application member according to another optional embodiment of the invention;

FIG. 10 is a cross-section of the application member of FIG. 9 taken from line X—X;

FIG. 11 is a perspective view of an application member according to an optional embodiment of the invention;

FIG. 12 is a cross-section of the application element of FIG. 11 taken from line XII—XII;

Figure 1:
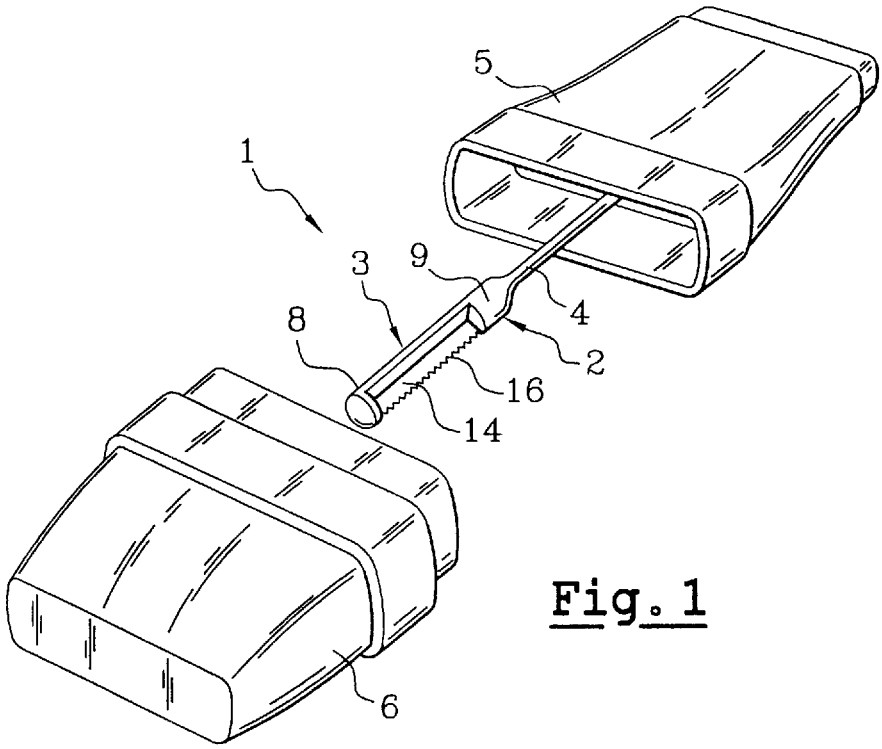
Figure 2:
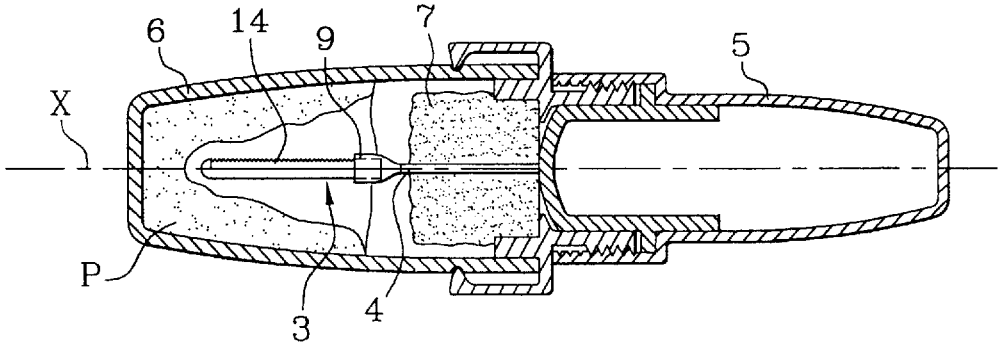
FIG. 2 is an axial section of the device of FIG. 1.

The applicator device 1 shown in FIGS. 1 and 2 comprises an applicator 2 having a wand 4 provided at one end with an application member 3 and at an opposite end with a handling member 5.

Figure 3:
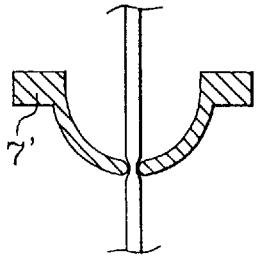
FIG. 3 is an optional alternative embodiment of a wiper member which may be provided with the device of FIG. 1.

The device 1 also may include a receptacle defining a reservoir 6 containing a supply of product P, such as mascara, for example. The receptacle 6 may be provided with a wiper member 7 for wiping product from the application member 3 as it is being withdrawn from an opening of the reservoir 6. The wiper member 7 may be formed from a foam, for example as shown in FIG. 2. Alternatively, as shown in FIG. 3, for example, the wiper member may comprise an elastomeric lip 7'. In the latter case, it may be advantageous for the wand 4 to have a relatively narrow region that takes up a position in register with the edge of the lip 7' so as to ensure that the wand 4 does not compress the lip 7' at rest. Wiper member may also be formed of other materials suitable for wiping product from application member 3 as the application member is withdrawn from the reservoir.

Optionally, the handling member 5 also may serve as a cap for closing the reservoir 6.

In the optional embodiment described, the application member 3 may include a support 8 of generally elongate shape extending along a longitudinal axis X. In this case, the axis X may coincide or be parallel with the longitudinal axis of the wand 4.

In an optional variant, the axis X may be at an angle, which may be a non-perpendicular angle, with the longitudinal axis of the wand 4 so as to obtain an applicator that is more ergonomic. The two axes also may optionally be disposed at a perpendicular angle to each other, as shown, for example, in FIG. 20.

Figure 4:
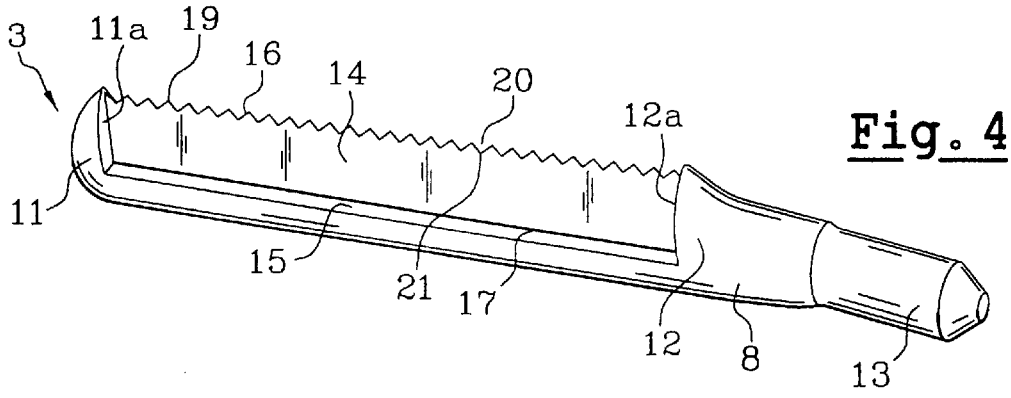
FIG. 4 is a perspective view of an application member of FIG. 1.

FIG. 4 is a perspective view of an optional embodiment of an application member 3.

The support 8 has a front end portion 11 and a rear end portion 12 disposed at opposite ends of the support 8. These end portions optionally may be shaped so as to make it easier for the application member 3 to pass through the wiper member 7. That is, they may have a rounded configuration or tapered configuration along the longitudinal axis of the base portion.

In this optional embodiment, a rigid or semi-rigid base portion 15 of the support 8 interconnects the front end and rear end portions 11, 12 and lies off-center with respect to those end portions. The front and rear portions 11 and 12 project from a top side of the base portion 15.

The front end and rear end portions 11 and 12 include respective opposing faces 11*a*, 12*a* that are substantially planar, mutually parallel, and substantially perpendicular to the axis X.

Opposite from the front end portion 11, the support 8 optionally has an end piece 13 formed at one end of the wand 4 for insertion in a housing 9 on the wand.

Above the support 8, between its front end portion 11 and rear end portion 12, the application member 3 has a planar wall 14 that is connected on one side to the base portion 15 and has a serrated free edge 16 on its opposite side.

The thickness of the wall 14, as measured in a direction perpendicular to the axis X, may be smaller, optionally considerably smaller, than that of the base portion 15 so that a side of the application member 3 and the top surface of the base portion 15 form one or more cavities 17 on either side of the wall 14. These cavities 17 may be suitable for holding the product P. In this way, the application member 3 may carry reserves of the product P, which may be useful when applying the product to the eyelashes or other hair.

The serrated edge 16 may form a plurality of notches 20, with the bottoms 21 of the notches 20 formed between teeth 19 being situated at a non-zero distance from the base portion 15.

Having a certain wall height between the bottoms 21 of the notches and the base portion 15 may ensure that the application member 3 can continue to be used for a certain length of time even though adjacent teeth 19 contact each other.

The presence of the notches may make it possible to spread the product in a satisfactory manner over the surface of eyelashes and also to grip them. Such gripping may be advantageous in order to curl them.

In the optional embodiment described with respect to FIG. 4, the ends of the wall 14 are connected over the full height of the wall to the faces 11*a* and 12*a* of the end portions 11 and 12.

Figure 5:
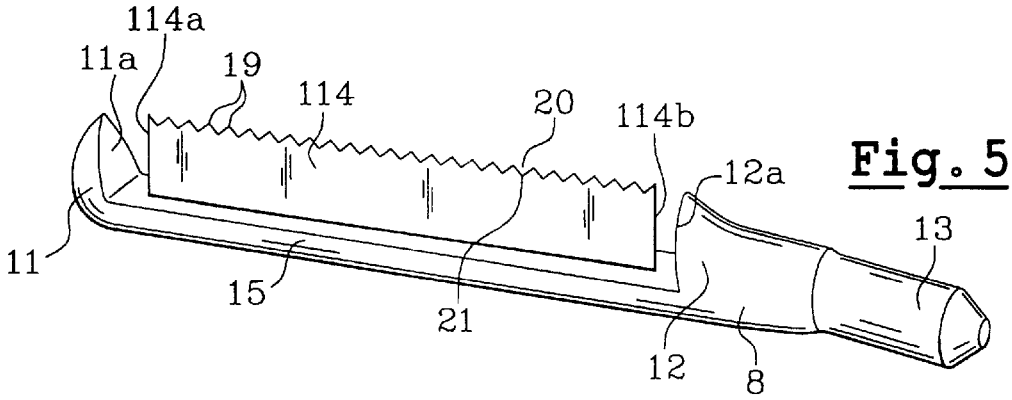
FIG. 5 is a perspective view an application member according to an optional embodiment of the invention.

In the optional embodiment of the invention shown in FIG. 5, a wall 114 is connected at a bottom edge only to the base portion 15. The wall 114 has axial ends 114*a* and 114*b* that are spaced apart from the faces 11*a* and 12*a*, i.e., they are free. This may provide greater flexibility of the application member 3 in the transverse direction. In an optional embodiment, not shown, the wall can be connected to the base portion in a center thereof with 2 free edges extending radially away from the base portion in opposite directions.

Figure 6:
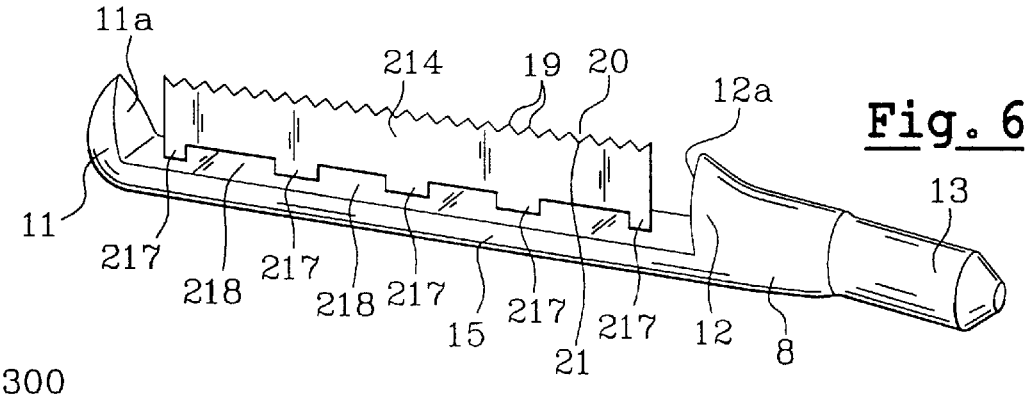
FIG. 6 is a perspective view of an application member according to another optional embodiment of the invention.

In the optional embodiment shown in FIG. 6, a wall 214 is connected to the base portion 15 by bridges of material 217. Gaps 218 are provided between the bridges 217. These gaps may hold product deposited on the application member 3.

Figure 7:
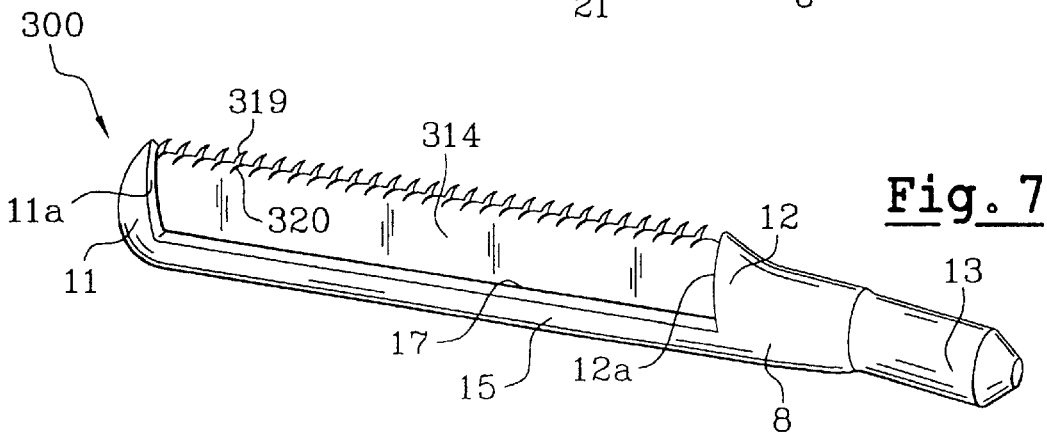
FIG. 7 is a perspective view of an application member according to another optional embodiment of the invention.

In the optional embodiments described above, the teeth 19 lie substantially in the same planes as the respective walls 14, 114, or 214. It is contemplated as within the scope of the present invention that it may be possible to incline the teeth outward, for example, alternately on either side of the plane of the wall to which they are connected, as shown in FIG. 7. This figure shows an application member 300 which differs from that described with reference to FIG. 4 in that the teeth 19 are replaced by teeth, or spikes, 319 that are curved alternately to one side and to the other of the wall 314 base portioning them. Notches 320 may be formed between adjacent teeth 319.

FIG. 8 shows an application member 400 which differs from that shown in FIG. 4 in that the tapered top portions of the teeth 19 include spikes 401. Each spike 401 may have a cylindrical body that is substantially circular in section together with a rounded end.

FIGS. 9 and 10 show an application member 30 having a central wall portion 31 and, extending from both sides of the central wall portion 31, respective top and bottom branch wall portions 32, 33. This application member presents in cross-section, as viewed along a longitudinal axis of the base portion 15, a generally flared configuration as can be seen in FIG. 10.

The application member in this optional embodiment may contain a relatively large amount of product P between the various walls 31, 32, and 33, and thereby may make it easier to apply product to the eyelashes and to increase the time during which the applicator can be used without needing to reload it with product. The product deposited on the eyelashes can be smoothed effectively on the eyelashes by means of serrated, or notched, edges 34 and 35 on the walls 32 and 33.

FIGS. 11 and 12 show an application member 40 which differs from the above-described application member 30 in that a central portion 31 of the wall is extended between the top branch portions 32 by a portion 41 of the wall 31 whose top edge 42 is notched. Product may accumulate between the walls 32 and 33, and between the walls 32 and 41. As shown in FIG. 12, an eyelash C may pick up product on making contact with the product contained between the above-mentioned walls, but without putting excess product onto the eyelash C because the eyelash passes between the notches of the serrated edges of these walls, as shown in FIG. 12. The eyelash C is capable of coming into contact simultaneously with at least two edges of the application member.

Figure 13:
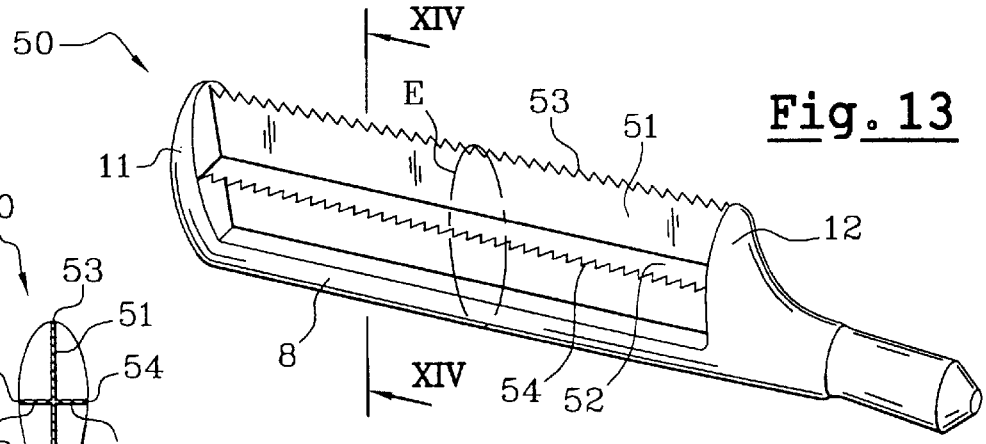
FIG. 13 is a perspective view of an application member according to another optional embodiment of the invention.
Figure 14:
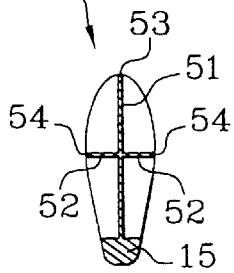
FIG. 14 is a cross-section of the application member of FIG. 13 taken from line XIV—XIV.

FIGS. 13 and 14 show an application member 50 having a wall 51 that is substantially vertical, and two horizontal walls 52 extending from either side of the wall 51. The application member walls present a cross-shaped section, as can be seen in FIG. 14. Each wall 51, 52 may have at least one outside free edge 53, 54 that has notches, and the entire wall assembly may be inscribed in an envelope surface E. This envelope surface E may interconnect the front and rear portions 11 and 12 and bear against them. The teeth, forming notches therebetween, may optionally project very slightly beyond the envelope surface.

During application, an eyelash may come into contact simultaneously with the top free edge 53 of the vertical wall 51 and with one of the side free edges 54.

Figure 15:
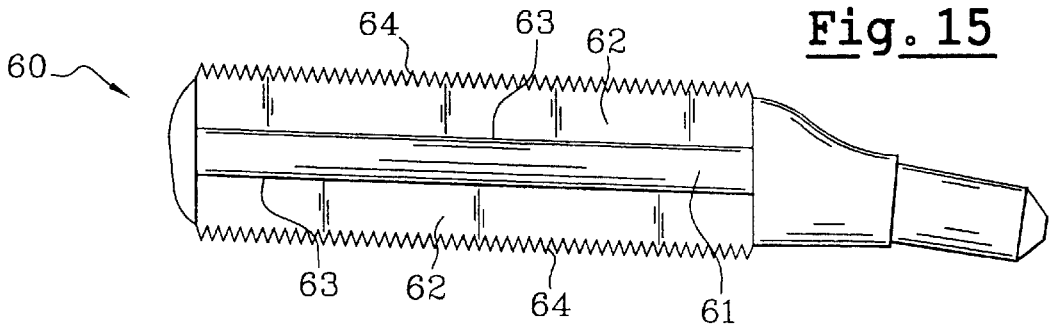
FIG. 15 is a side view of an application member according to an optional embodiment of the invention.

FIG. 15 shows an application member 60 which differs from those described in that the support has a base portion 61 which may be centrally disposed, instead of being off-center, with respect to the front end portion and rear end portion of the application element 60. On two diametrically opposite sides of this base portion 61, two walls 62 may be provided, with each wall connected via one side 63 to the base portion 61 and each wall presenting a free opposite edge 64 that is notched, e.g. serrated. In the optional embodiment of FIG. 15, the application member 60 has only two walls 62 provided with teeth.

Figure 16:
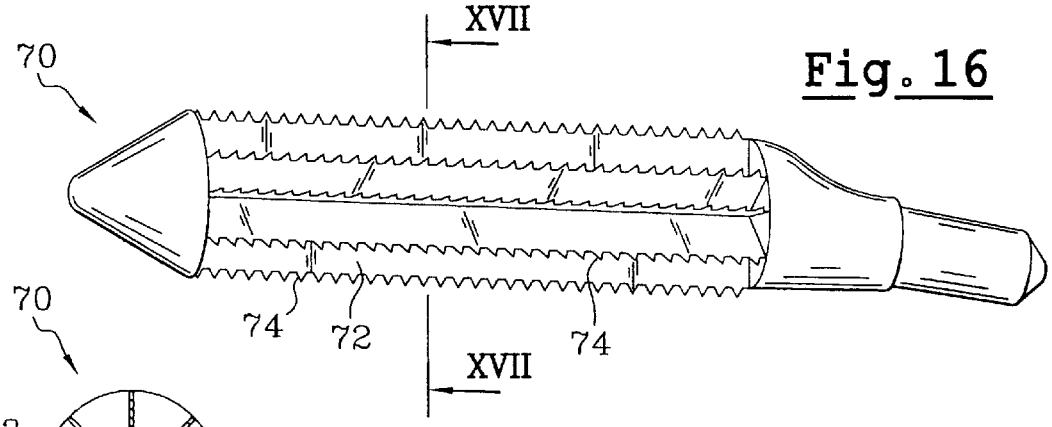
FIG. 16 is a diagrammatic perspective view of an application member according to an optional embodiment of the invention.
Figure 17:
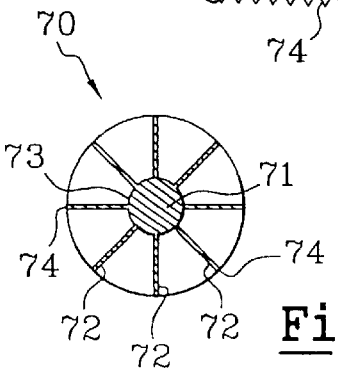
FIG. 17 is a cross-section of the application member of FIG. 16 taken from line XVII—XVII.

In the optional embodiment of FIG. 16, the application member 70 has a central base portion 71 and a plurality of walls 72 uniformly distributed angularly around it. Each wall has at least a portion along its length, such as an edge 73, connected to the link portion 71 and at least one opposite free edge 74 provided with teeth. The application member 70 thus optionally has a brush-like configuration. The teeth 74 form notches between one another in which eyelashes can be gripped.

It is contemplated as within the scope of the present invention for the application member to have not only a wall with a free edge defining notches whose bottoms lie at a non-zero distance from the base portion, but also to have projecting elements such as teeth, spikes, etc. These projecting elements may project from one side or from both sides of the wall, and may optionally connect to either the base portion or to the wall.

Figure 18:
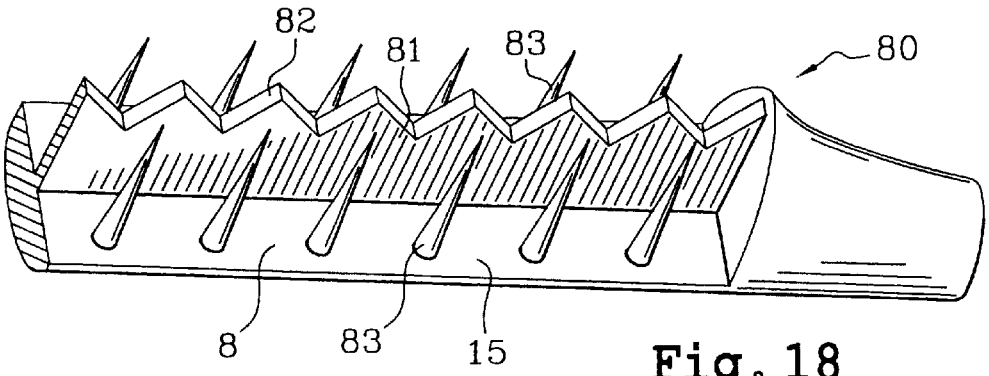
FIG. 18 is a perspective view of an application member according to another optional embodiment of the invention.

By way of optional example, FIG. 18 shows an application member 80 having a planar wall 81 with a notched free edge 82. On either side of the wall 81, a respective row of projecting elements 83 is provided along the length of the wall, with two rows of projecting elements 83 in the optional embodiment shown. In an optional configuration, the projecting elements 83 on opposite sides of the wall 81 may be alternately offset axially along a longitudinal axis of the base portion. The teeth 83 optionally may be taller than the wall 81, as shown in FIG. 18.

Figure 19:
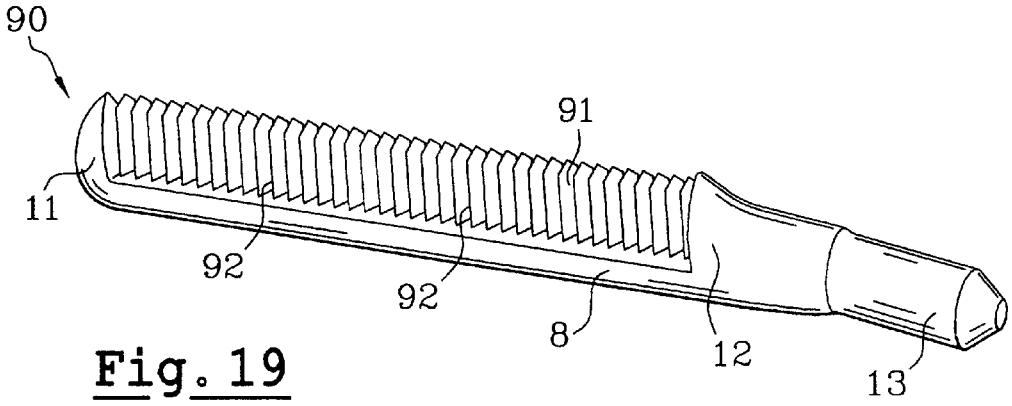
FIG. 19 is a perspective view of an application member according to yet another optional embodiment of the invention.

As shown in FIG. 19, the application member 90 optionally may have a wall 91 having folds along its length. This figure shows an application member 90 comprising a folded wall 91 between the front end and rear end portions 11, 12 of the base portion 8. The folds 92 shown lie between the high and low points of the notches formed between the teeth. The presence of these folds 92 may make it possible to enhance the eyelash-combing effect and to increase the surface area of the application member able to hold product to be applied.

In the optional embodiment shown in FIG. 19, the folds 92 extend substantially perpendicularly to the base portion surface and to the free edge, and are connected thereto vertically, and extend substantially parallel to the front end and rear end portions 11, 12.

Figure 20:
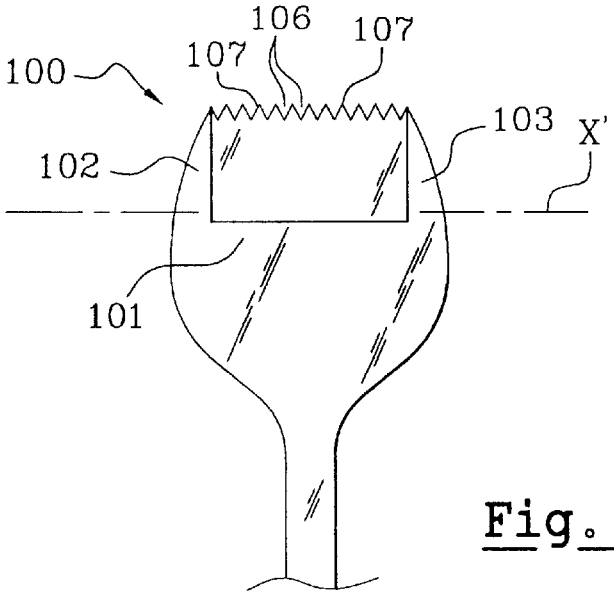
FIG. 20 is a side view of an application member according to another embodiment of the invention.

FIG. 20 shows an application member 100 connected to one end of a wand and comprising a base portion 101 with two lateral portions 102 and 103 disposed at opposite ends of the base portion. A wall 104 of smaller thickness than the base portion 101, as measured in a direction substantially perpendicular to a longitudinal axis X' of the base portion 101, extends between the lateral portions 102 and 103 along the axis X'. The axis X' is disposed substantially perpendicular to the axis of the wand of the applicator. On its edge facing away from the base portion 101, the wall 104 has notches 106 formed between teeth 107. The bottoms of the notches 106 may lie at a non-zero distance from the base portion 101.

Preferably, the devices and methods discussed herein are used for treating hair. However, in its broadest aspects, the present invention could be used to apply other types of products. Furthermore, sizes of various structural parts and materials used to make these parts are illustrative and exemplary only and one of ordinary skill in the art would recognize that these sizes and materials can be changed as necessary to produce different effects or desired characteristics of the dispensing assembly.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge is elongate substantially in a direction of a longitudinal axis of the wand, wherein sides of the wall extending between the base portion and the at least one free edge are substantially smooth, and wherein the application member is configured to apply product to eyelashes and/or eyebrows.

2. The device of claim 1, wherein a longitudinal axis of the application member and a longitudinal axis of the wand are substantially parallel to each other.

3. The device of claim 1, further comprising a reservoir for containing the product to be applied, the application member being configured to be removably positioned in the reservoir.

4. The device of claim 3, further comprising a wiper for wiping product from the application member, the wiper being associated with the reservoir.

5. The device of claim 3, wherein the reservoir contains mascara to be applied to eyelashes.

6. The device of claim 1, further comprising a handling member disposed on another end of the wand opposite to the end of the wand on which the application member is disposed.

7. The device of claim 6, wherein the handling member forms a cap configured to close a reservoir configured to contain a product to be applied.

8. The device of claim 6, wherein the handling member has a skirt portion and the wand extends into the skirt portion.

9. The device of claim 8, wherein screw threading is disposed on an internal portion of the skirt portion.

10. The device of claim 6, wherein a length of the wand is at least approximately 3 centimeters and a length of the handling member is at least approximately 3 centimeters.

11. The device of claim 1, wherein the application member is made as a single piece by molding.

12. The device of claim 1, wherein the application member is attached to the wand.

13. The device of claim 1, wherein the application member is integrally formed as a single piece with the wand.

14. The device of claim 1, wherein the application member includes end portions extending substantially perpendicular to the base portion at substantially opposite ends of the base portion, and the wall is connected over at least part of its height to the end portions.

15. The device of claim 1, wherein the wall is substantially planar.

16. The device of claim 1, wherein the application member includes end portions extending substantially perpendicular to the base portion, the base portion interconnecting the end portions.

17. The device of claim 16, wherein the base portion is disposed off-center relative to the end portions.

18. The device of claim 16, wherein the base portion is centrally disposed relative to the end portions.

19. The device of claim 16, wherein the application member includes a plurality of walls interconnecting the end portions.

20. The device of claim 19, wherein each of said walls has a free edge defining notches configured to hold product to be applied.

21. The device of claim 20, wherein the free edges substantially define an envelope surface interconnecting the end portions of the application member.

22. The device of claim 1, wherein the application member includes projecting elements disposed on the base portion adjacent the wall.

23. The device of claim 22, wherein the projecting elements are chosen from teeth and spikes.

24. The device of claim 22, where the application member includes two rows of projecting elements, the rows being disposed on opposite sides of the wall to one another.

25. The device of claim 1, wherein the application member includes a plurality of walls, each of the walls having at least one free edge defining notches.

26. The device of claim 25, wherein the walls are disposed in a flared configuration when the application member is observed in cross-section along a longitudinal axis of the application member.

27. The device of claim 26, wherein the walls are disposed so as to permit hair to come into contact simultaneously with two adjacent free edges during application of the product.

28. The device of claim 1, wherein the free edge of the wall is provided with teeth for applying the substance to eyelashes, the notches being formed by adjacent teeth.

29. The device of claim 28, wherein the free edge is provided with two rows of teeth, the teeth in each row being axially offset from each other along a longitudinal axis of the base portion.

30. The device of claim 28, wherein adjacent teeth are curved alternatively outward to opposite sides with respect to the longitudinal axis of the application member.

31. The device of claim 1, wherein the wall has axial ends that are free.

32. The device of claim 1, wherein the wall is connected to the base portion via bridges of material with gaps between the bridges capable of holding the product.

33. The device of claim 1, wherein the wand has a substantially circular cross-section.

34. The device of claim 1, wherein at least a portion of the wand has a cross-sectional area that is smaller than a cross-sectional area of the application member.

35. The device of claim 1, wherein the wand is configured to be disposed in a reservoir without engaging with the reservoir to close the reservoir.

36. The device of claim 1, wherein, in a plane, the base portion has a cross-sectional shape that differs from a cross-sectional shape of the wall.

37. The device of claim 1, wherein the base portion is elongated substantially in a direction of a longitudinal axis of the wand.

38. The device of claim 1, wherein the notches are V-shaped.

39. A method of applying a product to hair, comprising:

providing the device of claim 1;

loading at least a portion of the application member with a product to be applied to hair; and placing the application member in contact with the hair such that the product is applied to the hair.

40. The method of claim 39, wherein the loading includes loading at least some of the notches with product.

41. The method of claim 39, wherein the placing the application member in contact includes contacting the hair with the bottoms of at least some of the notches.

42. The method of claim 39, wherein the loading includes inserting the application member into a reservoir containing the product.

43. The method of claim 39, further comprising gripping the hair with the bottoms of at least some of the notches.

44. The method of claim 39, wherein the product is mascara and the hair includes eyelashes.

45. The method of claim 39, wherein the product is chosen from a solid, a semi-solid, a liquid, and a liquid-to-pasty product.

46. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein sides of the wall extending between the base portion and the at least one free edge are substantially smooth, and wherein a thickness of the wall is less than a width of the base portion as measured in a direction perpendicular to a longitudinal axis of the base portion.

47. The device of claim 46, wherein a cavity is defined by a surface of the base portion on which the wall is disposed and a side of the wall, the cavity being configured to hold a product to be applied.

48. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein sides of the wall extending between the base portion and the at least one free edge are substantially smooth, and wherein the wall includes branch portions extending outwardly from another portion of the wall.

49. The device of claim 48, wherein at least one of the branch portions has a free edge defining notches.

50. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein sides of the wall extending between the base portion and the at least one free edge are substantially smooth, and wherein the application member has a plurality of edges defining notches.

51. The device of claim 50, wherein the edges are disposed such that hair can come into contact with at least two of the edges during application of product to the hair.

52. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge of the wall extends substantially in a direction of a longitudinal axis of the wand, and wherein the application member is configured to apply product to eyelashes and/or eyebrows.

53. The device of claim 52, wherein sides of the wall extending between the base portion and the free edge include folds.

54. The device of claim 52, further comprising a reservoir for containing the product to be applied, the application member being configured to be removably positioned in the reservoir.

55. The device of claim 54, further comprising a wiper for wiping product from the application member, the wiper being associated with the reservoir.

56. The device of claim 54, wherein the reservoir contains mascara to be applied to eyelashes.

57. The device of claim 52, further comprising a handling member disposed on another end of the wand opposite to the end of the wand on which the application member is disposed.

58. The device of claim 57, wherein the handling member includes a skirt portion and the wand extends into the skirt portion.

59. The device of claim 58, wherein screw threading is disposed on an internal portion of the skirt portion.

60. The device of claim 59, wherein a length of the wand is at least approximately 3 centimeters and a length of the handling member is at least approximately 3 centimeters.

61. The device of claim 59, wherein the handling member forms a cap configured to close a reservoir configured to contain a product to be applied.

62. The device of claim 52, wherein the application member is made as a single piece by molding.

63. The device of claim 52, wherein the application member is attached to the wand.

64. The device of claim 52, wherein the application member is integrally formed as a single piece with the wand.

65. The device of claim 52, wherein the application member includes end portions extending substantially perpendicular to the base portion at substantially opposite ends of the base portion and the wall is connected over at least part of its height to the end portions.

66. The device of claim 52, wherein the wall is substantially planar.

67. The device of claim 52, wherein the application member includes end portions extending substantially perpendicular to the base portion, the base portion interconnecting the end portions.

68. The device of claim 67, wherein the base portion is disposed off-center relative to the end portions.

69. The device of claim 67, wherein the base portion is centrally disposed relative to the end portions.

70. The device of claim 67, wherein the application member includes a plurality of walls interconnecting the end portions.

71. The device of claim 70, wherein each of the walls has a free edge defining notches configured to hold a product.

72. The device of claim 71, wherein the free edges substantially define an envelope surface interconnecting the end portions of the application member.

73. The device of claim 52, wherein the application member includes projecting elements disposed on the base portion adjacent the wall.

74. The device of claim 73, wherein the projecting elements are chosen from teeth and spikes.

75. The device of claim 73, wherein the application member includes two rows of projecting elements, the rows being disposed on opposite sides of the wall to one another.

76. The device of claim 52, wherein the application member includes a plurality of walls, each of the walls having at least one free edge defining notches.

77. The device of claim 76, wherein the walls are disposed in a flared configuration when the application member is observed in cross-section along a longitudinal axis of the application member.

78. The device of claim 77, wherein the walls are disposed so as to permit hair to come into contact simultaneously with two adjacent free edges during application of product to the hair.

79. The device of claim 52, wherein the free edge of the wall is provided with teeth for applying the substance to eyelashes, the notches being formed by adjacent teeth.

80. The device of claim 79, wherein the free edge is provided with two rows of teeth, the teeth in each row being axially offset from each other along a longitudinal axis of the application member.

81. The device of claim 80, wherein adjacent teeth are curved alternatively outward to opposite sides with respect to the longitudinal axis of the application member.

82. The device of claim 52, wherein the wall has axial ends that are free.

83. The device of claim 52, wherein the wall is connected to the base portion via bridges of material with gaps between the bridges capable of holding the product.

84. The device of claim 52, wherein the wand has a substantially circular cross-section.

85. The device of claim 52, wherein at least a portion of the wand has a cross-sectional area that is smaller than a cross-sectional area of the application member.

86. The device of claim 52, wherein the wand is configured to be disposed in a reservoir without engaging with the reservoir to close the reservoir.

87. The device of claim 52, wherein the base portion has a cross-sectional shape that differs from a cross-sectional shape of the wall.

88. The device of claim 52, wherein the base portion is elongated substantially in a direction of the longitudinal axis of the wand.

89. The device of claim 52, wherein the notches are V-shaped.

90. A method of applying a product to hair, comprising:

providing the device of claim 52;

loading at least a portion of the application member with a product to be applied to hair; and placing the application member in contact with the hair such that the product is applied to the hair.

91. The method of claim 90, wherein the loading includes loading at least some of the notches with product.

92. The method of claim 90, wherein the placing the application member in contact includes contacting the hair with the bottoms of at least some of the notches.

93. The method of claim 90, wherein the loading includes inserting the application member into a reservoir containing the product.

94. The method of claim 90, further comprising gripping the hair with the bottoms of at least some of the notches.

95. The method of claim 90, wherein the product is mascara and the hair includes eyelashes.

96. The method of claim 90, wherein the product is chosen from a solid, a semi-solid, a liquid, and a liquid-to-pasty product.

97. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge of the wall extends in a direction non-perpendicular to a longitudinal axis of the wand, and wherein a thickness of the wall is less than a width of the base portion as measured in a direction perpendicular to a longitudinal axis of the base portion.

98. The device of claim 97, wherein a cavity is defined by a surface of the base portion on which the wall is disposed and a side of the wall, the cavity being configured to hold a product to be applied.

99. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge of the wall extends in a direction non-perpendicular to a longitudinal axis of the wand, and wherein the wall includes branch portions extending outwardly from another portion of the wall.

100. The device of claim 99, wherein at least one of the branch portions has a free edge defining notches.

101. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge of the wall extends in a direction non-perpendicular to a longitudinal axis of the wand, and wherein the application member has a plurality of free edges defining notches.

102. The device of claim 101, wherein the free edges are disposed such that hair can come into contact with at least two of the edges during application of product to the hair.

103. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a longitudinal axis of the application member and a longitudinal axis of the wand are substantially parallel to each other, and wherein the application member is configured to apply a product to eyelashes and/or eyebrows.

104. The device of claim 103, wherein at least one of the sides of the wall extending between the base portion and the free edge includes folds.

105. The device of claim 104, wherein the folds extend substantially perpendicularly to the free edge.

106. The device of claim 103, further comprising a handling member disposed on another end of the wand opposite to the end of the wand on which the application member is disposed.

107. The device of claim 106, wherein a length of the wand is at least approximately 3 centimeters and a length of the handling member is at least approximately 3 centimeters.

108. The device of claim 106, wherein the handling member forms a cap configured to close a reservoir configured to contain a product to be applied.

109. The device of claim 103, wherein the handling member includes a skirt portion and the wand extends into the skirt portion.

110. The device of claim 109, wherein screw threading is disposed on an internal portion of the skirt portion.

111. The device of claim 103, wherein the application member is made as a single piece by molding.

112. The device of claim 103, wherein the application member is attached to the wand.

113. The device of claim 103, wherein the application member is integrally formed as a single piece with the wand.

114. The device of claim 103, wherein the application member includes end portions extending substantially perpendicular to the base portion at substantially opposite ends of the base portion and the wall is connected over at least part of its height to the end portions.

115. The device of claim 103, wherein the wall is substantially planar.

116. The device of claim 103, wherein the application member includes end portions extending substantially perpendicular to the base portion, the base portion interconnecting the end portions.

117. The device of claim 116, wherein the base portion is disposed off-center relative to the end portions.

118. The device of claim 116, wherein the base portion is centrally disposed relative to the end portions.

119. The device of claim 116, wherein the applicator element includes a plurality of walls interconnecting the end portions.

120. The device of claim 116, where each of said walls has a free edge that is defining notches configured to hold a product.

121. The device of claim 120, where the free edges substantially define an envelope surface interconnecting the end portions of the application member.

122. The device of claim 103, where the application member includes projecting elements disposed on the base portion adjacent the wall.

123. The device of claim 122, wherein the projecting elements are chosen from teeth and spikes.

124. The device of claim 122, where the application member includes two rows of projecting elements, the rows being disposed on opposite sides of the wall to one another.

125. The device of claim 103, wherein the application member includes a plurality of walls, each of the walls having at least one free edge defining notches.

126. The device of claim 125, wherein the walls are disposed in a flared configuration when the application member is observed in cross-section along the longitudinal axis of the application member.

127. The device of claim 126, wherein the walls are disposed so as to permit hair to come into contact simultaneously with two adjacent free edges during application.

128. The device of claim 103, wherein the free edge of the wall is provided with teeth for applying the substance to eyelashes, the notches being formed by adjacent teeth.

129. The device of claim 128, wherein the free edge is provided with two rows of teeth, the teeth in each row being axially offset from each other along a longitudinal axis of the base portion.

130. The device of claim 129, wherein adjacent teeth are curved alternatively outward to opposite sides with respect to the longitudinal axis of the application member.

131. The device of claim 103, wherein the wall has axial ends that are substantially free.

132. The device of claim 103, wherein the wall is connected to the base portion via bridges of material with gaps between the bridges capable of holding the product.

133. The device of claim 103, wherein the wand has a substantially circular cross-section.

134. The device of claim 103, wherein at least a portion of the wand has a cross-sectional area that is smaller than a cross-sectional area of the application member.

135. The device of claim 103, wherein the wand is configured to be disposed in a reservoir without engaging with the reservoir to close the reservoir.

136. The device of claim 103, wherein the base portion has a cross-sectional shape that differs from a cross-sectional shape of the wall.

137. The device of claim 103, wherein the base portion is elongate substantially in a direction of the longitudinal axis of the wand.

138. The device of claim 103, wherein the notches are V-shaped.

139. A method of applying a product to hair, comprising:

providing the device of claim 103;

loading at least a portion of the application member with a product to be applied to hair; and placing the application member in contact with the hair such that the product is applied to the hair.

140. The method of claim 139, wherein the loading includes loading at least some of the notches with product.

141. The method of claim 139, wherein the placing the application member in contact includes contacting the hair with the bottoms of at least some of the notches.

142. The method of claim 139, wherein the loading includes inserting the application member into a reservoir containing the product.

143. The method of claim 139, further comprising gripping the hair with the bottoms of at least some of the notches.

144. The method of claim 139, wherein the product is mascara and the hair includes eyelashes.

145. The method of claim 139, wherein the product is chosen from a solid, a semi-solid, a liquid, and a liquid-to-pasty product.

146. A device for applying a product to hair, the device comprising:

a wand;

an application member disposed on an end of the wand, the application member having a base portion and at least one wall connected over at least a portion of its length to the base portion, the wall having at least one free edge defining a plurality of notches having bottoms disposed at a distance from the base portion; and a reservoir for containing the product to be applied, the application member being configured to be removably positioned in the reservoir, wherein a longitudinal axis of the application member and a longitudinal axis of the wand are substantially parallel to each other.

147. The device of claim 146, further comprising a wiper for wiping product from the application member, the wiper being associated with the reservoir.

148. The device of claim 146, wherein the reservoir contains mascara to be applied to eyelashes.

149. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a longitudinal axis of the application member and a longitudinal axis of the wand are substantially parallel to each other, and wherein a thickness of the wall is less than a width of the base portion as measured in a direction perpendicular to a longitudinal axis of the base portion.

150. The device of claim 149, wherein a cavity is defined by a surface of the base portion on which the wall is disposed and a side of the wall, the cavity being configured to hold a substance to be applied.

151. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a longitudinal axis of the application member and a longitudinal axis of the wand are substantially parallel to each other, and wherein the wall includes branch portions extending outwardly from another portion of the wall.

152. The device of claim 151, wherein at least one of the branch portions has a free edge defining notches.

153. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a longitudinal axis of the application member and a longitudinal axis of the wand are substantially parallel to each other, and wherein the application member has a plurality of free edges defining notches.

154. The device of claim 153, wherein the free edges are disposed such that hair can come into contact with at least two of the edges during application of product to the hair.

155. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a length of the at least one free edge is elongate substantially in a direction of a longitudinal axis of the wand, wherein a dimension of at least a portion of the wand in a direction perpendicular to a longitudinal axis of the wand is less than a length of the at least one free edge, and wherein the application member is configured to apply product to eyelashes and/or eyebrows.

156. The device of claim 155, wherein at least one of the sides of the wall extending between the base portion and the free edge include folds.

157. The device of claim 156, wherein the folds extend substantially perpendicular to the free edge of the application member.

158. The device of claim 155, further comprising a reservoir for containing the product to be applied, the application member being configured to be removably positioned in the reservoir.

159. The device of claim 158, further comprising a wiper for wiping product from the application member, the wiper being associated with the reservoir.

160. The device of claim 158, wherein the reservoir contains mascara to be applied to eyelashes.

161. The device of claim 155, further comprising a handling member disposed on another end of the wand opposite to the end of the wand on which the application member is disposed.

162. The device of claim 161, wherein the handling member includes a skirt portion and the wand extends into the skirt portion.

163. The device of claim 162, wherein screw threading is disposed on an internal portion of the skirt portion.

164. The device of claim 161, wherein a length of the wand is at least approximately 3 centimeters and a length of the handling member is at least approximately 3 centimeters.

165. The device of claim 161, wherein the handling member forms a cap configured to close a reservoir for containing a product to be applied.

166. The device of claim 155, wherein the application member is made as a single piece by molding.

167. The device of claim 155, wherein the application member is attached to the wand.

168. The device of claim 155, wherein the application member is integrally formed as a single piece with the wand.

169. The device of claim 155, wherein the application member includes end portions extending substantially perpendicular to the base portion at substantially opposite ends of the base portion and the wall is connected over at least part of its height to the end portions.

170. The device of claim 155, wherein the wall is substantially planar.

171. The device of claim 155, wherein the application member includes end portions extending substantially perpendicular to the base portion, the base portion interconnecting the end portions.

172. The device of claim 171, wherein the base portion is disposed off-center relative to the end portions.

173. The device of claim 171, wherein the base portion is centrally disposed relative to the end portions.

174. The device of claim 171, wherein the application member includes a plurality of walls interconnecting the end portions.

175. The device of claim 174, where each of said walls has a free edge defining notches configured to hold a product.

176. The device of claim 175, where the free edges substantially define an envelope surface interconnecting the end portions of the application member.

177. The device of claim 155, where the application member includes projecting elements disposed on the base portion adjacent the wall.

178. The device of claim 177, wherein the projecting elements are chosen from teeth and spikes.

179. The device of claim 177, where the application member includes two rows of projecting elements, the rows being disposed on opposite sides of the wall to one another.

180. The device of claim 155, wherein the application member includes a plurality of walls, each of the walls having at least one free edge defining notches.

181. The device of claim 180, wherein the walls are disposed in a flared configuration when the application member is observed in cross-section along a longitudinal axis of the application member.

182. The device of claim 181, wherein the walls are disposed so as to permit hair to come into contact simultaneously with two adjacent free edges during application.

183. The device of claim 155, wherein the free edge of the wall is provided with teeth, the notches being formed by adjacent teeth.

184. The device of claim 183, wherein the free edge is provided with two rows of teeth, the teeth in each row being axially offset from each other along a longitudinal axis of the application member.

185. The device of claim 183, wherein adjacent teeth are curved alternatively outward to opposite sides with respect to the longitudinal axis of the application member.

186. The device of claim 155, wherein the wall has axial ends that are free.

187. The device of claim 155, wherein the wall is connected to the base portion via bridges of material with gaps between the bridges capable of holding the product.

188. The device of claim 155, wherein the wand has a substantially circular cross-section.

189. The device of claim 155, wherein at least a portion of the wand has a cross-sectional area that is smaller than a cross-sectional area of the application member.

190. The device of claim 155, wherein the wand is configured to be disposed in a reservoir without engaging with the reservoir to close the reservoir.

191. The device of claim 155, wherein the base portion has a cross-sectional shape that differs from a cross-sectional shape of the wall.

192. The device of claim 155, wherein the base portion is elongate substantially in a direction of the longitudinal axis of the wand.

193. The device of claim 155, wherein the notches are V-shaped.

194. A method of applying a product to hair, comprising:

providing the device of claim 155;

loading at least a portion of the application member with a product to be applied to hair; and placing the application member in contact with the hair such that the product is applied to the hair.

195. The method of claim 194, wherein the loading includes loading at least some of the notches with product.

196. The method of claim 194, wherein the placing the application member in contact includes contacting the hair with the bottoms of at least some of the notches.

197. The method of claim 194, wherein the loading includes inserting the application member into a reservoir containing the product.

198. The method of claim 194, further comprising gripping the hair with the bottoms of at least some of the notches.

199. The method of claim 194, wherein the product is mascara and the hair includes eyelashes.

200. The method of claim 194, wherein the product is chosen from a solid, a semi-solid, a liquid, and a liquid-to-pasty product.

201. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a dimension of at least a portion of the wand in a direction perpendicular to a longitudinal axis of the wand is less than a length of the at least one free edge, and wherein a thickness of the wall is less than a width of the base portion as measured in a direction perpendicular to a longitudinal axis of the base portion.

202. The device of claim 201, wherein a cavity is defined by a surface of the base portion on which the wall is disposed and a side of the wall, the cavity being configured to hold product to be applied.

203. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a dimension of at least a portion of the wand in a direction perpendicular to a longitudinal axis of the wand is less than a length of the at least one free edge, and wherein the wall includes branch portions extending outwardly from another portion of the wall.

204. The device of claim 203, wherein at least one of the branch portions has a free edge defining notches.

205. A device for applying a product to hair, the device comprising:

a wand; and an application member disposed on an end of the wand, the application member having a base portion and at least one wall connected over at least a portion of its length to the base portion, the wall having at least one free edge defining a plurality of notches having bottoms disposed at a distance from the base portion, wherein a dimension of at least a portion of the wand in a direction perpendicular to a longitudinal axis of the wand is less than a length of the at least one free edge, and wherein the application member includes a plurality of free edges defining notches.

206. The device of claim 205, wherein the free edges are disposed such that hair can come into contact with at least two of the free edges during application of product to the hair.

207. A device for applying a product to hair, the device comprising:

a wand;

a handling member disposed on a first end of the wand; and an application member disposed on a second end of the wand opposite to the first end, the application member having a base portion and at least one wall connected over at least a portion of its length to the base portion, the wall having at least one free edge defining a plurality of notches having bottoms disposed at a distance from the base portion, wherein a length of the at least one free edge is elongate substantially in a direction of a longitudinal axis of the wand, and wherein the application member is configured to apply a product to eyelashes and/or eyebrows.

208. The device of claim 207, wherein sides of the wall extending between the base portion and the free edge include folds.

209. The device of claim 208, wherein the folds extend substantially perpendicular to the free edge.

210. The device of claim 207, further comprising a reservoir for containing the product to be applied, the application member being configured to be removably positioned in the reservoir.

211. The device of claim 210, further comprising a wiper for wiping product from the application member, the wiper being associated with the reservoir.

212. The device of claim 210, wherein the reservoir contains mascara to be applied to eyelashes.

213. The device of claim 210, wherein the handling member is removably engageable with the resevoir so as to allow the reservoir to be opened and closed.

214. The device of claim 213, wherein the handling member includes screw threading configured to cooperate with screw threading on the reservoir.

215. The device of claim 210, wherein the reservoir defines an opening through which the application member is configured to pass.

216. The device of claim 215, wherein a wiper is disposed proximate the opening, the wiper being configured to wipe product from the application member as it is removed from the reservoir.

217. The device of claim 207, wherein the handling member includes a skirt portion and the wand extends into the skirt portion.

218. The device of claim 217, wherein screw threading is disposed on an internal portion of the skirt portion.

219. The device of claim 207, wherein a length of the wand is at least approximately 3 centimeters and a length of the handling member is at least approximately 3 centimeters.

220. The device of claim 207, wherein the application member is made as a single piece by molding.

221. The device of claim 207, wherein the application member is attached to the wand.

222. The device of claim 207, wherein the application member is integrally formed as a single piece with the wand.

223. The device of claim 207, wherein the application member includes end portions extending substantially perpendicular to the base portion at substantially opposite ends of the base portion and the wall is connected over at least part of its height to the end portions.

224. The device of claim 207, wherein the wall is substantially planar.

225. The device of claim 207, wherein the application member includes end portions extending substantially perpendicular to the base portion, the base portion interconnecting the end portions.

226. The device of claim 225, wherein the base portion is disposed off-center relative to the end portions.

227. The device of claim 225, wherein the base portion is centrally disposed relative to the end portions.

228. The device of claim 225, wherein the application member includes a plurality of walls interconnecting the end portions.

229. The device of claim 228, where each of said walls has a free edge defining notches configured to hold a product.

230. The device of claim 229, where the free edges substantially define an envelope surface interconnecting the end portions of the application member.

231. The device of claim 207, where the application member includes projecting elements disposed on the base portion adjacent the wall.

232. The device of claim 231, wherein the projecting elements are chosen from teeth and spikes.

233. The device of claim 231, where the application member includes two rows of projecting elements, the rows being disposed on opposite sides of the wall to one another.

234. The device of claim 207, wherein the application member includes a plurality of walls, each of the walls having at least one free edge defining notches.

235. The device of claim 234, wherein the walls are disposed in a flared configuration when the application member is observed in cross-section along a longitudinal axis of the application member.

236. The device of claim 235, wherein the walls are disposed so as to permit hair to come into contact simultaneously with two adjacent free edges during application of product.

237. The device of claim 207, wherein the free edge of the wall is provided with teeth for applying the substance to eyelashes, the notches being formed by adjacent teeth.

238. The device of claim 237, wherein the free edge is provided with two rows of teeth, the teeth in each row being axially offset from each other along a longitudinal axis of the application member.

239. The device of claim 238, wherein adjacent teeth are curved alternatively outward to opposite sides with respect to the longitudinal axis of the application member.

240. The device of claim 207, wherein the wall has axial ends that are free.

241. The device of claim 207, wherein the wall is connected to the base portion via bridges of material with gaps between the bridges capable of holding the product.

242. The device of claim 207, wherein the wand has a substantially circular cross-section.

243. The device of claim 207, wherein at least a portion of the wand has a cross-sectional area that is smaller than a cross-sectional area of the application member.

244. The device of claim 207, wherein the wand is configured to be disposed in a reservoir without engaging with the reservoir to close the reservoir.

245. The device of claim 207, wherein the base portion has a cross-sectional shape that differs from a cross-sectional shape of the wall.

246. The device of claim 207, wherein the base portion is elongate substantially in a direction of a longitudinal axis of the wand.

247. The device of claim 207, wherein the notches are V-shaped.

248. A method of applying a product to hair, comprising:

providing the device of claim 207;

loading at least a portion of the application member with a product to be applied to hair; and placing the application member in contact with the hair such that the product is applied to the hair.

249. The method of claim 248, wherein the loading includes loading at least some of the notches with product.

250. The method of claim 248, wherein the placing the application member in contact includes contacting the hair with the bottoms of at least some of the notches.

251. The method of claim 248, wherein the loading includes inserting the application member into a reservoir containing the product.

252. The method of claim 248, further comprising gripping the hair with the bottoms of at least some of the notches.

253. The method of claim 248, wherein the product is mascara and the hair includes eyelashes.

254. The method of claim 248, wherein the product is chosen from a solid, a semisolid, a liquid, and a liquid-to-pasty product.

255. A device for applying a product to hair, the device comprising:

a wand;

a handling member disposed on a first end of the wand; and an application member disposed on a second end of the wand opposite to the first end, the application member having a base portion and at least one wall connected over at least a portion of its length to the base portion, the wail having at least one free edge defining a plurality of notches having bottoms disposed at a distance from the base portion, wherein a thickness of the wall is less than a width of the base portion as measured in a direction perpendicular to a longitudinal axis of the base portion.

256. The device of claim 255, wherein a cavity is defined by a surface of the base portion on which the wall is disposed and a side of the wall, the cavity being configured to hold product to be applied.

257. A device for applying a product to hair, the device comprising:

a wand;

a handling member disposed on a first end of the wand; and an application member disposed on a second end of the wand opposite to the first end, the application member having a base portion and at least one wall connected over at least a portion of its length to the base portion, the wall having at least one free edge defining a plurality of notches having bottoms disposed at a distance from the base portion, wherein the wall includes branch portions extending outwardly from another portion of the wall.

258. The device of claim 257, wherein at least one of the branch portions has a free edge defining notches.

259. A device for applying a product to hair, the device comprising:

a wand;

a handling member disposed on a first end of the wand; and an application member disposed on a second end of the wand opposite to the first end, the application member having a base portion and at least one wall connected over at least a portion of its length to the base portion, the wall having at least one free edge defining a plurality of notches having bottoms disposed at a distance from the base portion, wherein the application member has a plurality of free edges defining notches.

260. The device of claim 259, wherein the free edges are disposed such that hair can come into contact with at least two of the free edges during application of product to the hair.

* * * * *

UNITED STATES PATENT AND TRADEMARK OFFICE

CERTIFICATE OF CORRECTION

PATENT NO. : 6,675,814 B2
DATED : January 13, 2004
INVENTOR(S) : Jean-Louis H. Gueret It is certified that error appears in the above-identified patent and that said Letters Patent is hereby corrected as shown below:

Title page, Item [54] and Column 1, line 1,
Replace "METHOD" with -- METHODS --;

Title page,
Item [30], Foreign Application Priority Data, replace "May 26, 2001" with -- May 26, 2000 --;

Column 13,
Line 37, replace "elongated" with -- elongate --;

Column 23,
Line 10, replace "a semisolid," with -- a semi-solid, --; and
Line 22, replace "the wail" with -- the wall --.

Signed and Sealed this

Twenty-third Day of March, 2004

JON W. DUDAS
*Acting Director of the United States Patent and Trademark Office*